United States Patent [19]

Pielet et al.

[11] Patent Number: 4,746,361

[45] Date of Patent: May 24, 1988

[54] CONTROLLING DISSOLVED OXYGEN CONTENT IN MOLTEN STEEL

[75] Inventors: Howard M. Pielet, Munster; Larry A. Frank, Crown Point, both of Ind.; William Edgar, Glenwood, Ill.; Milan Alavanja, Crown Point, Ind.

[73] Assignee: Inland Steel Company, Chicago, Ill.

[21] Appl. No.: 34,331

[22] Filed: Apr. 3, 1987

[51] Int. Cl.[4] ..... C21C 7/00

[52] U.S. Cl. ..... 75/53; 75/51.1; 75/51.7; 75/58

[58] Field of Search ..... 75/51.1, 51.7, 53, 58

[56] References Cited

U.S. PATENT DOCUMENTS

| | | | |
|---|---|---|---|
| 2,049,004 | 7/1936 | Flannery | 75/55 |
| 2,698,784 | 1/1955 | Timmins | 75/27 |
| 3,201,226 | 8/1965 | Spolders | 75/59.28 |
| 3,725,041 | 4/1973 | Ramachandran | 75/60 |
| 3,744,991 | 7/1973 | Lewis et al. | 75/53 |
| 3,802,866 | 4/1974 | Rinesch et al. | 75/52 |
| 3,839,017 | 10/1974 | Schempp | 75/52 |
| 3,861,888 | 1/1975 | Heise | 75/59.28 |
| 3,891,429 | 6/1975 | Cox et al. | 75/60 |
| 3,980,469 | 9/1976 | Forster | 75/58 |
| 3,997,335 | 12/1976 | Kolb et al. | 75/60 |
| 4,484,946 | 11/1984 | Ototani | 75/58 |

*Primary Examiner*—Peter D. Rosenberg

*Attorney, Agent, or Firm*—Marshall, O'Toole, Gerstein, Murray & Bicknell

[57] ABSTRACT

The dissolved oxygen content in a bath of molten steel is controlled, in one embodiment, by diluting a slag layer atop the bath with an oxide such as lime (CaO), to reduce the percentage of MnO and FeO in the slag, and stirring the bath of molten steel. In another embodiment, a gaseous mixture of an inert gas and carbon monoxide is disequilibrium with the carbon and dissolved oxygen content is bubbled through the bath.

21 Claims, No Drawings

CONTROLLING DISSOLVED OXYGEN CONTENT IN MOLTEN STEEL

BACKGROUND OF THE INVENTION

The present invention relates generally to methods for treating a bath of molten steel to adjust the composition thereof and more particularly to a method for adjusting the dissolved oxygen content in molten steel.

Molten steel is generally prepared in a steel refining furnace such as a basic oxygen furnace, an electric furnace and, in decreasing utilization, an open hearth furnace. Molten steel prepared in a steel refining furnace generally contains dissolved oxygen which is usually regarded as an undesirable impurity. A conventional expedient for removing dissolved oxygen from molten steel is to add elements, such as aluminum, silicon, titanium or zirconium, that form stable oxides. These metal elements are referred to hereinafter as solid deoxidizing agents. A deoxidizing treatment employing a solid deoxidizing agent is usually conducted outside of the steel refining furnace, typically in a ladle into which the molten steel has been poured from the steel refining furnace.

In certain steels, sulfur is added to the steel to improve the machinability of the steel. Sulfur combines with manganese to form manganese sulfide inclusions in the solidified steel, and these inclusions improve the machinability of the steel. Manganese sulfide inclusions have a tendency to be elongated in the direction of rolling when a solidified steel casting is rolled into a shape, and elongated manganese sulfide inclusions are less desirable from a machinability standpoint than globular manganese sulfide inclusions. Likewise, smaller manganese sulfide inclusions are considered less desirable than larger inclusions.

If a certain quantity of dissolved oxygen is retained in the molten steel (e.g. 60–150 parts per million (ppm) (mg/kg)), upon solidification, the retained oxygen combines with the manganese sulfide to form oxygen containing manganese sulfide inclusions (manganese oxysulfides) which are more resistant to deformation or elongation during rolling than are those manganese sulfide inclusions formed in steel containing very little dissolved oxygen. The retained oxygen also increases the size of the inclusions. The end result of the retained oxygen is the formation of relatively large, globular manganese oxysulfides in the rolled steel shape.

Although it is desirable to retain in the molten steel a limited amount of dissolved oxygen, it is undesirable to retain in the molten steel a dissolved oxygen content above that needed to provide relatively large, globular manganese oxysulfides. However, if the surplus dissolved oxygen content is removed with solid deoxidizing agents, this forms, in the solidified steel, oxide inclusions which can have a detrimental effect on machinability. Accordingly, it is undesirable to control the surplus dissolved oxygen content in a free machining steel with solid deoxidizing agents.

In cases where the dissolved oxygen content is less than that required to provide the desired globular manganese oxysulfides, the dissolved oxygen content must be increased.

Molten steel prepared in a steel refining furnace is conventionally poured from the furnace into a ladle from which the molten steel is introduced into a casting mold which may be either an ingot mold or a continuous casting mold. If the steel is flowed into a continuous casting mold, it is first flowed from the ladle into a tundish which contains one or more outlet openings through which the steel flows to the continuous casting mold. Some tundishes contain internal structure in the form of baffles, dams, weirs and the like to control or direct the movement of the molten steel through the tundish, and this, as well as the general configuration of the tundish and its entry and exit locations, causes the molten steel to undergo a mixing action as it flows through the tundish. Embodiments of tundishes containing the internal structure and general configuration discussed above are disclosed in Jackson, et al., U.S. application Ser. No. 808,570, filed Dec. 13, 1985, and the disclosure thereof is incorporated herein by reference.

The bath of molten steel in the ladle is usually covered with a slag layer, and the molten steel in the tundish can also be covered with a slag layer. Typically, the slag layer on the molten steel in the ladle or in the tundish comprises, at least to some extent, slag from the steel refining furnace in which the molten steel was initially prepared.

In both the ladle and the tundish there is an interface between the bath of molten steel and the slag layer. In the tundish, the area of this interface per unit mass of molten steel is relatively large while in the ladle the area of this interface per unit mass of molten steel is relatively small. In the tundish it is several times greater than in the ladle.

The bath of molten steel in the ladle can be stirred by bubbling gases, such as argon, through the bath in the ladle, by electromagnetic stirring, by alloy injection, etc. As a result, there is a substantial turnover of molten steel at the interface between the bath of molten steel and the slag layer in a ladle in which the bath of molten steel undergoes stirring.

Typically, there is dissolved oxygen in the bath of molten steel, and in the covering slag layer there are oxides, such as manganese oxide (MnO) and iron oxide (FeO), having a cation corresponding to one of the metallic elements (Mn, Fe) in the bath of molten steel. The dissolved oxygen in the molten steel and the oxides in the slag layer usually move toward equilibrium with each other, i.e. the relative proportions of each move toward stable values absent some external disruption. There is movement toward equilibrium because of the natural tendency for chemical reactions to occur and to continue until they produce a state of equilibrium. The respective amounts of dissolved oxygen and slag layer oxides which are in equilibrium can be calculated from available thermodynamic data.

For a bath of molten steel made in a basic oxygen furnace and which is covered in the ladle with a layer of slag from the same furnace and to which ferro-manganese has been added at the ladle, the movement toward equilibrium is typically in the direction whereby oxygen from the slag oxides enters the molten steel to increase the dissolved oxygen content thereof. As the temperature of the molten steel bath drops, the amount of dissolved oxygen which the molten steel will hold in equilibrium also drops.

As noted above, a molten steel bath in a ladle may be stirred with an inert gas such as argon. The stirring gas may also contain, in addition to argon, carbon monoxide. For a given carbon content in the molten steel, there is an equilibrium between the carbon monoxide in the stirring gas and the carbon and oxygen in the bath of molten steel through which the carbon monoxide gas flows. The respective amounts of each which are in equilibrium can be readily calculated from available thermodynamic data.

SUMMARY OF THE INVENTION

The present invention provides methods for controlling the dissolved oxygen content in molten steel, particularly in molten steel which upon solidification will form manganese sulfide inclusions. As a result of methods performed in accordance with the present invention, the inclusions are in the desired form of relatively large, globular manganese oxysulfide inclusions which resist deformation when the solidified steel undergoes rolling. Undesirable oxide inclusions which interfere with machinability are avoided.

The methods are performed outside of the steel refining furnace, typically in a ladle, although some embodiments may be performed in a tundish. The methods are performed with a steel containing carbon, manganese and iron.

In the embodiment performed in a ladle, untreated molten steel is first prepared in a steel refining furnace and then poured into the ladle to form therein a bath of molten steel. The bath of molten steel contains dissolved oxygen. In the ladle, the bath of molten steel is covered with a slag layer comprising an undiluted slag containing an oxide which, in the percentage thereof existing in the undiluted slag, initially moves toward equilibrium with dissolved oxygen in the bath. Typically, the undiluted slag is the slag from the steel refining furnace, and the oxide moving toward equilibrium is MnO or FeO or both. The slag also contains other compounds conventionally found in slag resulting from steel-making operations.

It may be necessary to reduce (or increase) the amount of dissolved oxygen in the molten steel bath, e.g. a reduction may be required if the dissolved oxygen content is greater than that required to impart the necessary globularity to the manganese sulfide inclusions upon solidification and rolling of the steel.

In accordance with one embodiment of the present invention, the dissolved oxygen content of the bath is decreased by diluting the slag in the slag layer. More particularly, the percentage of slag layer oxide (MnO, FeO) which was moving toward equilibrium with the dissolved oxygen in the steel is decreased by adding to the slag layer a diluent oxide, e.g. calcium oxide (lime) (CaO).

Diluting the slag disrupts the initial movement toward equilibrium between the oxide in the slag layer and the dissolved oxygen in the bath of molten steel. Assuming that, before disruption, the movement toward equilibrium was in the direction whereby oxygen from the slag oxides enters the molten steel, the disruption reverses the direction of that movement. If the oxides in the slag were in equilibrium with the dissolved oxygen in the steel, the disruption caused by diluting the slag produces movement in the desired direction whereby dissolved oxygen from the molten steel enters the slag as oxide. If the initial movement toward equilibrium were in the desired direction, but the movement was relatively insubstantial or otherwise insufficient, the disruption caused by diluting the slag will increase the movement in the desired direction.

The discussion in the preceding paragraph assumes that the slag is diluted to decrease the dissolved oxygen content of the molten steel. If the dissolved oxygen content of the molten steel were to be increased, one would add MnO and/or FeO to the slag layer.

Referring again to the embodiment in which the slag is diluted with lime, the result thereof is to form, at the molten steel bath-slag layer interface, additional amounts of the diluted oxide (e.g. MnO and/or FeO), and these additional amounts are absorbed into the slag layer as a result of the natural tendency to re-establish an equilibrium between that oxide in the slag layer and the dissolved oxygen in the bath of molten steel.

Oxide formation within the bath of molten steel is avoided because essentially all of the oxides which form as a result of the above-described disruption of the equilibrium will form at the interface between the bath of molten steel and the slag layer. Oxides which form at the interface are readily absorbed by the slag, thereby avoiding the formation of oxides within the steel. The manganese, the iron and the dissolved oxygen which combine to form oxides come from the molten steel at the interface.

The mixing action which the bath of molten steel undergoes as a result of the stirring thereof, replenishes the manganese, iron and dissolved oxygen removed from the molten steel at the interface, and the reaction at the interface which causes the formation of oxides continues until the dissolved oxygen content in the bath of molten steel is in equilibrium with the oxides in the slag layer. If the formation of oxides at the interface ceases before the dissolved oxygen content is decreased to the desired level, formation of additional oxide at the interface can be reinitiated by adding more diluent oxide to the slag layer, and this procedure is continued until the dissolved oxygen content is decreased to the desired level.

The procedure described above can be employed in the tundish as well as in the ladle. In the tundish, the increased area of the molten steel-slag interface per unit mass of molten steel compensates for the absence in the tundish of external stirring forces, such as a stirring gas or electro-magnetic stirring, which are employed when the procedure is performed in the ladle. The present invention, however, does not exclude the use of external stirring forces (e.g. a stirring gas) in the tundish.

If the dissolved oxygen content in the molten steel is less than that desired, e.g. less than that required to provide the desired size and globularity to the manganese sulfide inclusions, the dissolved oxygen content can be increased by employing another expedient in accordance with the present invention. The method employing this expedient is performed in the ladle and involves bubbling through the ladle a stirring gas composed of argon and carbon monoxide. The percentage of carbon monoxide in the stirring gas is greater than that which is in equilibrium with the carbon and dissolved oxygen content in the steel. As a result, the proportion of carbon monoxide in the stirring gas decreases producing an increase in the proportion of dissolved oxygen and carbon in the molten steel. This change in proportions will continue for so long as the gaseous mixture containing carbon monoxide in excess of that in equilibrium with carbon and oxygen in the molten steel is continued.

A gaseous mixture of argon and carbon monoxide can also be used to decrease the dissolved oxygen content of the molten steel, if the percentage of carbon monoxide in the gas is less than that which is in equilibrium with the carbon and dissolved oxygen in the steel. Decreasing the dissolved oxygen content in the steel in this manner can be used as a supplement to the first method described above, which dilutes the FeO and/or MnO content of the slag layer. The first-described method can be employed without changing the carbon content of the steel. The later-described method can be employed without substantially changing the manganese content of the steel.

The later-described method can also be employed as a supplement to the first-described method, in cases where the dissolved oxygen content is reduced too much, in which case the later-described method would be employed to produce a slight increase in the dissolved oxygen content.

Other features and advantages are inherent in the methods claimed and disclosed or will become apparent to those skilled in the art from the following detailed description.

DETAILED DESCRIPTION

The present invention will be described in the context of producing free machining steels containing relatively large, globular manganese oxysulfides. However, the methods of the present invention may also be employed in virtually all instances where it is necessary or desirable to control the dissolved oxygen content of the molten steel without employing solid deoxidizing agents.

In a typical embodiment of the present invention, molten steel from a basic oxygen furnace is poured into a ladle. Certain alloying ingredients may be added to the molten steel at the ladle during the tapping operation. These include manganese (added as ferro-manganese), carbon (added as coke) and sulfur. A typical heat of steel poured into the ladle has a mass of about 200,000 kg. The bath of molten steel in the ladle is covered with a layer of slag. The slag layer is composed principally of slag from the basic oxygen furnace. Typically, the proportions of FeO and MnO in the slag relative to the dissolved oxygen content of the steel are such that there would be a movement toward equilibrium in the direction whereby oxygen from the oxides in the slag enters the bath of molten steel. However, the dissolved oxygen content in the molten steel is typically above that needed for producing the desired size and globularity in the manganese sulfide inclusions. Accordingly, some lime (CaO) is added to the slag from the basic oxygen furnace during the tapping operation. This has a diluting effect on the slag in the slag layer in the ladle, decreasing the percentages of MnO and FeO in the slag layer with the intent of producing a decrease in the dissolved oxygen content in the molten steel bath covered by the slag layer.

The slag layer in the ladle has a mass of about 1000–3000 kg and is typically between 75 and 150 mm in depth. If the slag layer is too deep, some deslagging may be required. The minimum depth of the slag is determined by factors such as the need to cover exposed upper portions of the ladle lining.

Typical compositions for the molten steel bath in the ladle are set forth below, with iron being the balance:

TABLE I

| | Wt. % | | | | |
|---|---|---|---|---|---|
| Sample | C | Mn | P | S | Si |
| A | 0.076 | 0.85 | 0.066 | 0.29 | 0.017 |
| B | 0.073 | 0.93 | 0.080 | 0.27 | 0.001 |
| C | 0.080 | 1.09 | 0.078 | 0.31 | 0.001 |

Typical approximate amounts for the principal components of the slag layer covering the bath of molten steel in the ladle, following the tapping operation, are set forth below:

TABLE II

| | Wt. % | | | | | |
|---|---|---|---|---|---|---|
| Example | $SiO_2$ | $Al_2O_3$ | S | CaO | FeO | MnO |
| 1 | 14 | 5 | 1.5 | 44 | 12 | 17 |
| 2 | 5 | 5 | 4 | 26 | 13 | 29 |
| 3 | 5 | 5 | 5 | 39 | 8 | 24 |

The aim temperature in the ladle after the tapping operation is about 1590° C.

For purposes of producing globular manganese oxysulfides, it is usually desirable for the bath of molten steel to contain a dissolved oxygen content in the range 60–150 mg/kg (ppm). The particular amount in this range depends upon the manganese and sulfur content of the steel.

If the diluting oxide added to the slag during tapping did not produce a sufficient decrease in the molten steel's dissolved oxygen content, that content may be further decreased during a procedure known as ladle metallurgy treatment, a procedure in which other adjustments can be made to the composition of the steel. Ladle metallurgy treatment is typically conducted in a ladle metallurgy furnace which is a heated compartment having a removable roof or cover into which is placed the ladle containing the bath of molten steel with a slag layer thereon. The slag layer should have a minimum depth sufficient to render unexposed the upper portions of the ladle lining, to protect those ladle portions from the electric arcs with which the ladle metallurgy furnace is heated.

An example of one approximate aim slag composition during ladle metallurgy treatment is as follows:

TABLE III

| Ingredient | Wt. % |
|---|---|
| CaO | 36 |
| $SiO_2$ | 5 |
| $Al_2O_3$ | 6 |
| MgO | 2.5 |
| MnO | 30 |
| FeO | 10 |
| S | 5 |
| $P_2O_5$ | 1 |

In one embodiment, a typical aim dissolved oxygen content in the molten steel is an amount no greater than 130 mg/kg (ppm). If the oxygen content of the steel in the ladle is greater than the aim amount, the slag in the ladle is further diluted with lime, e.g. about 400–500 kg at a time. The oxygen content is then monitored periodically after the slag has been diluted with lime, and further dilutions with lime are made if necessary.

Set forth below in Table IV is an example showing the effect on the dissolved oxygen content of further diluting the slag layer with lime. In this particular example, the composition of the molten steel in the ladle was, in wt. %: about 0.08 carbon, about 1 manganese, less than 0.002 silicon, nil aluminum, about 0.3 sulfur and less than about 0.08 phosphorous. Before further dilution, the slag layer had an approximate composition, in wt. %, of about: 40 CaO, 5 $SiO_2$, 5 $Al_2O_3$, 2.5 MgO, 30 MnO, 12 FeO and 5.5 S. The aim dissolved oxygen content for this example was about 120 mg/kg (ppm).

The bath of molten steel was stirred electromagnetically.

TABLE IV

| Elapsed Time, min. | Event | Temp., °C. | Dissolved oxygen, mg/kg |
|---|---|---|---|
| Start | cover on at ladle metallurgy furnace | — | — |
| 7 | — | 1573 | 151 |
| 16 | add alloying ingredients to molten steel | — | — |
| 23 | add alloying ingredients to molten steel | — | — |
| 28 | add 400 kg lime to slag | — | — |
| 38 | — | 1573 | 138 |
| 44 | — | 1577 | 123 |
| 54 | add 393 kg lime to slag | — | — |
| 59 | — | 1583 | 121 |
| 69 | — | 1580 | 121 |
| 76 | — | 1579 | 121 |
| 79 | remove ladle from ladle metallurgy furnace | — | — |

In the ladle, diluting the slag layer with lime must be accompanied by a stirring of the molten steel bath. Merely adding lime to the slag layer as a diluent oxide is not enough. Stirring produces a turnover of molten steel at the interface between the molten steel bath and the slag layer to produce continued oxide formation there and absorption of the oxide thus formed into the slag layer.

As noted above, in the ladle, stirring is accomplished in one embodiment by bubbling a gas upwardly through the bath of molten steel. The gas is preferably an inert gas such as argon. The stirring gas may also be a mixture of argon and carbon monoxide, and this will be discussed more fully below.

Stirring may also be accomplished electromagnetically or by other expedients heretofore utilized to obtain a mixing action in a ladle containing a bath of molten steel.

The diluent oxide or lime may be added to the slag during tapping, during ladle metallurgy treatment or during both. It is necessary to dilute the slag layer because, before dilution, the iron oxide and manganese oxide percentages in the slag relative to the dissolved oxygen content in the molten steel are such that there would be a movement toward equilibrium in the direction of oxygen from the slag oxides entering the bath of molten steel. This is the condition which existed when the molten steel and the slag were still in the steel refining furnace. In other words, the slag which covered the molten steel in the steel refining furnace had MnO and FeO contents which resulted in the equilibrium movement described in the preceding part of this paragraph. In order to reduce the dissolved oxygen content of the molten steel, it is necessary to dilute the slag with lime, thereby reducing the percentages of MnO and FeO in the slag layer and causing the formation of additional MnO and FeO at the interface between the molten steel and the slag layer, in the manner previously described.

Although the preferred slag diluent is lime, other diluent oxides may be employed. These comprise aluminum oxide ($Al_2O_3$), magnesium oxide (MgO), zirconium oxide (ZrO) and dolomite ($CaMgO_2$). Silica ($SiO_2$) should be avoided as a diluent oxide.

The dissolved oxygen content of the molten steel bath is decreased without the need to employ solid deoxidizing agents, which are excluded from the bath of molten steel. As a result, the solidified steel does not contain any additional undesirable oxides which could impair the machinability of the steel.

In conventional steel-making operations, the molten steel in the ladle is introduced from the ladle either into ingot molds or into a tundish when a continuous casting operation is employed to solidify the steel. When the molten steel is introduced into a tundish, the treatment for reducing the dissolved oxygen content in the molten steel can be performed at the tundish in lieu of performing the treatment in the ladle. In the tundish, the molten steel would be covered with the same slag layer described above in connection with performing the treatment in the ladle, and the slag layer is diluted with the same diluent oxide (e.g. lime) as is employed in that embodiment of the method performed at the ladle.

Unlike the ladle, however, external mixing forces, such as gas-induced stirring, or electromagnetic stirring, are usually not available at the tundish. However, in the tundish the area of the interface between the bath of molten steel in the tundish and the slag layer, per unit mass of molten steel, is several times greater than the area of that interface in a ladle. Accordingly, less stirring is required to accomplish the treatment than is necessary when the treatment is performed in a ladle. In addition, there is an internal mixing force at the tundish resulting from the action of the ladle stream entering the tundish. Moreover, a tundish can contain internal structural elements, such as baffles, dams and weirs, which direct the movement of the molten steel as it flows through the tundish, and this, plus the mixing action due to the ladle stream as well as the general configuration of a tundish and its entry and exit locations, produces sufficient mixing to enable satisfactory performance of the treatment in the tundish.

In other words, the movement of the molten steel through the tundish subjects the molten steel to sufficient mixing action, in the context of the relatively large area of the slag layer-molten steel interface, per unit mass of molten steel, in the tundish.

Tundish treatment can be performed in those situations where, for one reason or another, expedients for stirring or agitating the molten steel in the ladle are unavailable.

As noted above, when the bath of molten steel undergoes treatment in a ladle, the bath can be stirred by bubbling upwardly through the bath a stirring gas composed of argon and carbon monoxide. For a given carbon content, there is a percentage of carbon monoxide in the stirring gas which is an equilibrium with carbon and oxygen in the bath of molten steel. This characteristic can be employed to change the dissolved oxygen content in the steel. It will also change the carbon content of the steel, but it will not substantially change the manganese (or iron) content of the steel as may the method wherein the slag is diluted with lime.

In that embodiment of the method wherein the oxygen content of the molten steel bath is changed by bubbling through the bath a gaseous mixture comprising argon and carbon monoxide, the oxygen content may be either increased or decreased. For example, for a steel with a carbon content of 0.08 wt. %, if there are 100 mg/kg (ppm) of dissolved oxygen in the steel, this amount of oxygen is in equilibrium with a gas containing 40% carbon monoxide. If the carbon monoxide content of the gas is below 40% it will remove oxygen (and carbon) from the steel to form additional carbon monoxide. If the carbon monoxide content of the gas is above 40%, oxygen (and carbon) from the carbon monoxide will go into the molten steel. Thus by controlling the carbon monoxide content of the stirring gas bubbled through the steel, oxygen can either be added or withdrawn from the molten steel.

This method, employing carbon monoxide in the stirring gas, may be utilized in connection with the same steels described above in connection with the method wherein a diluent oxide is added to the slag. Both methods are employed with a steel typically containing about 0.06–0.09 wt. % carbon, and the oxygen content is controlled by both methods so that it is at a desired amount in the range of about 60–150 mg/kg (ppm) at the time the steel undergoes solidification. In both methods, solid deoxidizing agents are excluded from the steel.

Hydrogen can cause problems in the steels described above, and in the method employing carbon monoxide in the stirring gas, hydrocarbon reducing agents are excluded from the bath of molten steel during the performance of the method.

For a given carbon content and a given dissolved oxygen content in the molten steel, the percentage of carbon monoxide in the stirring gas which is in equilibrium therewith is information which is either available in handbooks, or its determination is within the ordinary skill of steel-making metallurgists. Similarly for a given dissolved oxygen content in molten steel, the percentage of MnO or FeO in a covering slag layer which is in equilibrium with that amount of dissolved oxygen is information which is available or determinable.

The amount of diluent oxide necessary to add to the slag layer in order to reduce the dissolved oxygen content to the desired level, is something which can be calculated theoretically, at least initially, but it can also be determined empirically by adding the diluent oxide to the slag layer in batches and thereafter periodically monitoring the dissolved oxygen content of the molten steel. If the oxygen content is not reduced sufficiently after adding a given amount of diluent oxide (e.g. 400–500 kg of lime), an additional amount of diluent oxide can be added until the periodic monitoring of the dissolved oxygen content of the molten steel shows that the desired level has been reached.

With respect to the method employing carbon monoxide in the stirring gas, the amount of gas required to change the oxygen content to the desired level can be theoretically calculated, initially, but it can also be determined empirically by continuously or periodically introducing the gas into the bath of molten steel and periodically monitoring the dissolved oxygen content of the molten steel and eventually discontinuing the introduction of the gas into the steel when the oxygen content has changed to the desired level.

The foregoing detailed description has been given for clearness of understanding only, and no unnecessary limitations should be understood therefrom, as modification will be obvious to those skilled in the art.

We claim:

1. A method for treating, outside of a steel refining furnace, a bath of molten steel containing carbon and dissolved oxygen, said method comprising the steps of:

preparing untreated molten steel in a steel refining furnace;

pouring said untreated molten steel into a vessel to form therein a bath of molten steel;

covering said bath in said vessel with a slag layer;

diluting the slag in said slag layer with a diluent oxide;

said slag layer comprising an oxide other than said diluent oxide which, in the percentage thereof existing in the undiluted slag, was in or was moving toward equilibrium with the dissolved oxygen in said bath;

and stirring said bath;

said diluting step comprising decreasing the percentage of said other oxide in said slag, thereby disrupting said equilibrium or said movement thereto, and causing to form, at the molten steel bath-slag layer interface, additional amounts of said other oxide which are absorbed into said slag layer as a result of the tendency to reestablish an equilibrium between said other oxide in the slag layer and the dissolved oxygen in the bath;

whereby the dissolved oxygen content of said bath is decreased while the formation of oxides within said bath is avoided.

2. A method as recited in claim 1 wherein:

said other oxide is at least one of MnO and Feo.

3. A method as recited in claim 2 wherein said diluting step comprises:

adding to said undiluted slag a diluent oxide comprising at least one of CaO, $Al_2O_3$, MgO, ZrO and $CaMgO_2$.

4. A method as recited in claim 3 wherein:

said adding step is continued until the dissolved oxygen in said bath decreases to the desired level.

5. A method as recited in claim 1 wherein said stirring step comprises:

bubbling a gas upwardly through said bath.

6. A method as recited in claim 5 wherein said gas comprises:

a mixture of an inert gas and carbon monoxide.

7. A method as recited in claim 6 wherein:

the percentage of said carbon monoxide in said gas is in disequilibrium with the dissolved oxygen content in said bath of molten steel;

whereby there is a change in the respective percentages of carbon monoxide in said gas and dissolved oxygen and carbon in said molten steel bath toward the percentages of each at which equilibrium exists.

8. A method as recited in claim 1 wherein:

said untreated steel is prepared in a steel refining furnace;

and said undiluted slag comprises slag from said steel refining furnace, said slag containing MnO and FeO.

9. A method as recited in claim 1 and comprising:

excluding solid deoxidizing agents from said bath of molten steel in said vessel.

10. A method as recited in claim 1 wherein:

said other oxide in the undiluted slag is moving toward equilibrium with the dissolved oxygen in said molten steel;

and said disrupting step comprises reversing the direction of that movement.

11. A method as recited in claim 1 wherein:

said other oxide in the undiluted slag is in equilibrium with the dissolved oxygen in the molten steel;

and said disrupting step comprises creating a disequilibrium.

12. A method as recited in claim 1 wherein:

said dissolved oxygen in the molten steel is moving toward equilibrium with said other oxide in the slag layer in the direction whereby dissolved oxygen from the molten steel enters the slag as said oxide;

and said disrupting step comprises increasing the movement in said direction.

13. A method for treating, outside of a steel refining furnace, a bath of molten steel containing carbon and dissolved oxygen, said method comprising the steps of:

preparing untreated molten steel in a steel refining furnace;

pouring said untreated molten steel into a ladle;

flowing said molten steel from said ladle into a tundish to form therein a bath of molten steel;

covering said bath in said tundish with a slag layer;

and diluting the slag in said slag layer with a diluent oxide;

said slag layer comprising an oxide other than said diluent oxide which, in the percentage thereof existing in the undiluted slag, was in or was moving toward equilibrium with the dissolved oxygen in said bath;

the area of the molten steel bath-slag layer interface in said tundish being substantially greater per unit mass of molten steel than the surface area per unit mass of molten steel in said ladle;

said diluting step comprising decreasing the percentage of said other oxide in said slag, thereby disrupting said equilibrium or said movement thereto, and causing to form, at the molten steel bath-slag layer interface, additional amounts of said other oxide which are absorbed into said slag layer as a result of the tendency to reestablish an equilibrium between said other oxide in the slag layer and the dissolved oxygen in the bath;

whereby the dissolved oxygen content of said bath is decreased while the formation of oxides within said bath is avoided.

14. A method as recited in claim 13 wherein:

the molten steel in said ladle is substantially unagitated.

15. A method as recited in claim 13 and comprising:

flowing said molten steel from said tundish into a casting mold;

and subjecting said molten steel to a mixing action in said tundish as a result of the movement of the steel through the tundish.

16. A method for treating, outside of a steel refining furnace, a bath of molten steel containing carbon and dissolved oxygen, said method comprising the steps of:

preparing untreated molten steel in a steel refining furnace;

pouring said untreated molten steel into a vessel to form therein a bath of molten steel;

covering said bath in said vessel with a slag layer;

said slag layer comprising an oxide which is in or is moving toward equilibrium with the dissolved oxygen in said bath;

stirring said bath;

and changing the dissolved oxygen content of said bath to a predetermined desired level by changing, in said vessel, the percentage of said oxide in said slag, thereby disrupting said equilibrium or said movement thereto, whereby there is a change in the respective percentages in the molten steel of dissolved oxygen and of the cation of said oxide;

continuing the change in percentage of said oxide in said slag until the percentage of said oxide in the slag layer is substantially in equilibrium with said predetermined desired level of dissolved oxygen in the bath;

and avoiding the formation of oxides within said bath.

17. A method for changing the dissolved oxygen content of a bath of molten steel containing dissolved oxygen and carbon, said method comprising:

determining the dissolved oxygen content and carbon content of said bath;

introducing into said bath a gaseous mixture comprising an inert gas and carbon monoxide;

mixing said gaseous mixture within said bath;

providing said gaseous mixture with a percentage of carbon monoxide different than that which is in equilibrium with the dissolved oxygen content and carbon content of said bath;

whereby there is a change in the proportion of carbon monoxide in said gas and a change in the proportion of dissolved oxygen and carbon in said molten steel bath toward the percentages of each at which equilibrium exists;

and continuing said introducing and mixing steps until the dissolved oxygen content in said bath changes to the desired level.

18. In combination with the method recited in claim 17:

solidifying said molten steel;

said molten steel containing manganese and sulfur at the time of said solidifying step;

restricting the amount of solid deoxidizing agents in said steel to permit dissolved oxygen in the molten steel to combine with said manganese and sulfur to form inclusions of oxygen-containing manganese sulfide in the solidified steel;

and controlling the amount of dissolved oxygen in said molten steel with the method recited in claim 17 to promote the formation of oxygen-containing manganese sulfide inclusions in the solidified steel.

19. A method as recited in claim 18 wherein:

said molten steel contains about 0.06–0.09 wt. % carbon and the dissolved oxygen content is controlled by said method so that it is at a desired amount in the range of about 60 to 150 parts per million (mg/kg) at the time of said solidifying step.

20. A method as recited in claim 19 and comprising:

excluding hydrocarbon reducing agents from said bath of molten steel during the performance of said method.

21. A method as recited in claim 17 wherein:

the percentage of carbon monoxide in said gaseous mixture is greater than that which is in equilibrium with the dissolved oxygen content and the carbon content of said bath;

whereby there is a decrease in the proportion of carbon monoxide in said gaseous mixture and an increase in the proportion of dissolved oxygen and carbon in said molten steel bath.

* * * * *